US005622352A

United States Patent [19]

Swindoll

[11] Patent Number: 5,622,352

[45] Date of Patent: Apr. 22, 1997

[54] CONNECTED ARCH NAIL PULLER FOR CLAW HAMMER

[76] Inventor: Phillip L. Swindoll, 143 Due West Dr., Mt. Juliet, Tenn. 37122

[21] Appl. No.: 622,435

[22] Filed: Mar. 25, 1996

[51] Int. Cl.[6] ..... B25C 11/00; B66F 15/00

[52] U.S. Cl. ..... 254/26 E; 254/26 R; 254/27

[58] Field of Search ..... 254/26 E, 26 R, 254/27, 19, 18, 25; 81/20

[56] References Cited

U.S. PATENT DOCUMENTS

| | | | |
|---|---|---|---|
| 724,542 | 4/1903 | Brownell | 254/26 R |
| 2,747,835 | 5/1956 | Belgard | 254/26 R |
| 3,885,772 | 5/1975 | Balkus, Jr. | 254/26 |
| 3,963,215 | 6/1976 | Connor | 254/26 R |
| 4,216,808 | 8/1980 | Royce | 254/26 R |
| 4,533,116 | 8/1985 | Panovic | 254/26 R |
| 5,249,776 | 10/1993 | Johnson | 254/26 E |
| 5,441,236 | 8/1995 | Kiernan | 254/26 E |

*Primary Examiner*—Timothy V. Eley
*Assistant Examiner*—Lee D. Wilson

[57] ABSTRACT

A conventional claw hammer is fitted with a connected arch intermediate the hand-held end of the handle and the head which defines the conventional claw. The connected arch contains a teardrop shaped notch defined as parallel to the handle and so positioned to ease in the removal of a nail from a work surface. The connected arch is made from a hardened steel material, or that of the same strength and likeness, designed to withstand high bearing prestores in conjunction with the removal of nails or spikes from a work surface.

1 Claim, 1 Drawing Sheet

CONNECTED ARCH NAIL PULLER FOR CLAW HAMMER

BACKGROUND OF THE INVENTION

1. Field of the Invention

The present invention relates to hammer head and shaft adapted to be fixed to a connected arch, and more particularly pertains to removing nails with the connected arch leverage points for nails of varying sizes.

2. Description of the Prior Art

Claw Hammers have been used for many years for extracting nails and spikes from a work surface. A claw hammer is particularly useful for removing nails from the work surface, because the hammer shaft provides leverage and thus a mechanical advantage which helps in overcoming resistance of the nail or spike to being pulled from the work surface. Difficulty can be experienced with a common claw hammer in extracting heavy long nails or spikes. This difficulty can be overcome by rising a separate specialized nail puller with claws. Often long nails are deformed when being extracted with a common claw hammer or nail puller.

Various devices have been invented to increase mechanical advantage of a claw hammer for extracting nails and/or spikes. By way of example, the prior an discloses in U.S. Pat. No. 4,533,116 to Panovic a claw hammer with varying pivots points U.S. Pat. No. 3,885,772 to Balkus, Jr. discloses a pivoted nail pulling device for claw hammer.

U.S. Pat. No. 3,963,215 to Connor discloses a nail extractor tool.

U.S. Pat. No. 5,441,236 to Kiernan discloses claw hammer with adjustable pivot points.

U.S. Pat. No. 5.249,776 to Johnson discloses an adjustable leverage claw hammer.

While devices in some of these patents may be adequate for removing short or light nails, the fulcrum members of such patents are relatively weak when compared to the forces encountered in extracting long nails or spikes, and such devices would be prone to failure over extended periods of heavy usage. The hinged portions of said previously patent devices pose a weak link when forces are transferred during usage from the fulcrum to the handle or claws. High beating pressures can create failures in hinged designed devices.

Also some of the other fulcrum devices which are hinged to the hammer head have a tendency to accidentally extend from the head during normal hammering, resulting in faulty operation and damage to said work surface and device.

SUMMARY OF THE INVENTION

The present invention relates generally to improvements for the claw hammer or the like, and deals specifically with a connected arch, of steel or like material, to be manufactured in conjunction with a claw hammer handle process or conveniently mounted to the handle portion of such hammer in order to permit use of such device in removing or withdrawing rails or spikes easily, without the use of other leveraging objects. The connected arch invention greatly increases the pulling capacity and leverage bearing pressures of said hammer with greater efficiency than that of the conventional claw hammer or nail pulling device.

It is to be understood that the invention is not limited in its application to the details of construction and to the arrangements of the components set forth in the following description or illustrated in the drawings. The invention is capable of other embodiments and of being practiced and carded out in other ways. Also, it is to be understood that the phraseology and terminology employed herein are for the purpose of descriptions and should not be regarded as limiting.

It is therefore an object of this present invention to provide new and improved hammers with the connected arch advantages.

It is further object of this present invention to provide new and improved claw hammers with the connected arch that may be manufactured easily and cost effectively.

BRIEF DESCRIPTION OF THE DRAWINGS

The invention is better understood as cited in the drawings set forth wherein.

DESCRIPTION OF THE PREFERRED EMBODIMENT

Figure 1:
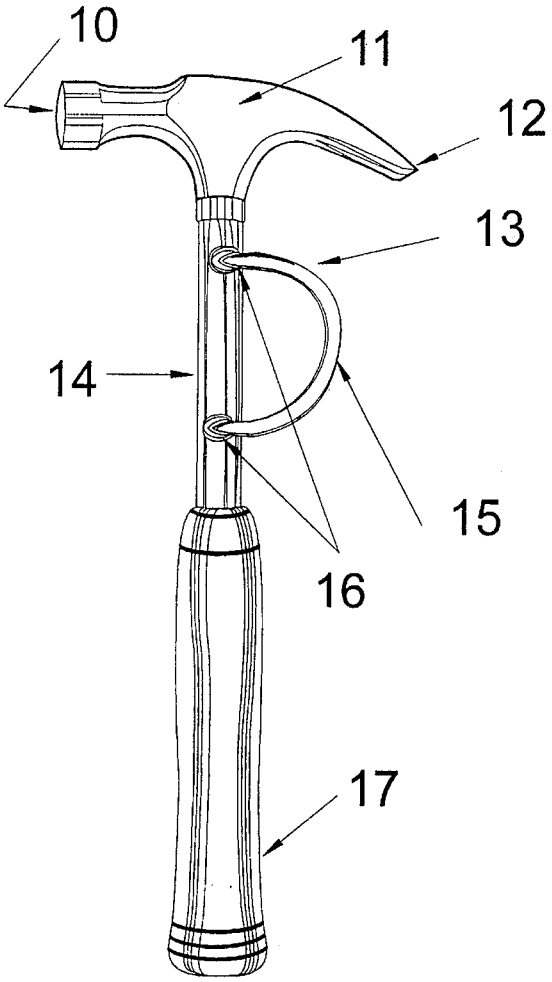
FIG. 1. is the side view elevation of the claw hammer with connected arch nail puller.

With reference now to the drawings and in particular to FIG. 1 thereof, the preferred embodiment of the new connected arch nail puller for claw hammer embodying the principles and concepts of the present invention will be described.

More specifically, FIG. 1 the embodiment contains a second operational end composed of a flat anvil surface 10, the fulcrum 11 and the claws 12 used for driving and removing nails. The handle 14 has a first gripping end 17 for being held by the user. A third operation portion the connected arch 13 has a teardrop shaped notch 15 used for removing nails or spikes with greater leverage and stability with the location of attachments 16 to the handle.

Figure 2:
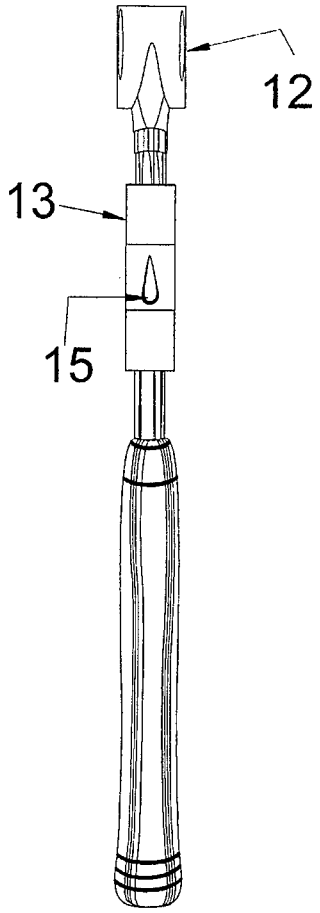
FIG. 2. is a rear elevation of said invention detailing the teardrop shaped notch of the connected arch that accepts and holds the nail or spike for removal.

FIG. 2. illustrate the rear view of the embroilment and more specifically the V-shaped claws 12 with the connected arch 13 with reference to the teardrop shaped notch 15 used for removing nails or spikes.

Figure 3A:
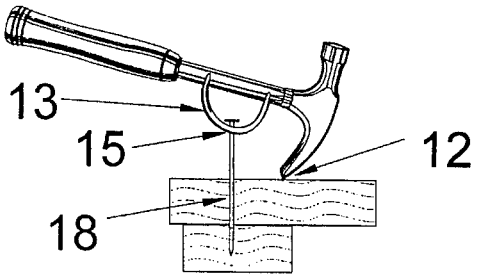
FIGS. 3(*a, b*) denotes the nail fitted into the tear shaped notch, illustrating the position of increased leverage of the connected arch nail puller.
Figure 3B:
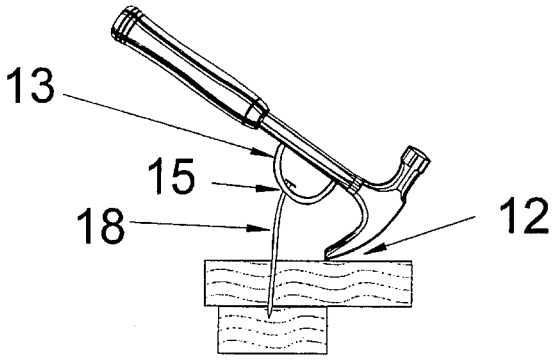

FIG. 3, (*a*) and (*b*), illustrate the pivot point at claws 12 in relation to the increased leverage point of the connected arch 13, with a nail 18 being placed in the teardrop shaped notch 15 and removed.

The connected arch nail puller for claw hammers improves one of the most common problems when is encountered when using the claw to remove nails or spikes. Everyone that has used a claw hammer has experienced the difficulties in removing long nails or spikes due to the ineffective leverage points created by the fulcrum and the claws. The remedy is to increase the leverage points by more typically using a piece of wood or spacer block under the fulcrum while removing the nail or spike. This is time consuming and not always easy to control. The connected arch nail puller for claw hammers easily and conveniently provides the increased leverage to remove the nail or spike quickly.

With respect to the above description, it is to be realized that the optimum dimensional relationships for the pans of the invention, to include variations in size, material, shape, form, function and manner of operation, assembly and use, are deemed readily apparent and obvious to one skilled in the art, and all equivalent relationships to those illustrated in the drawings am intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hammer comprising, in combination:

an elongated handle with a first gripping end for being held by a user, a second operational end for driving and removing a nail or spike, a third operational portion comprising an arch for pulling and removing a nail or spike;

the second operational end comprising a head having a nail driving side with a flat anvil surface and a nail or spike removal side with a claw having a V-shaped slot positionable under a head of the nail or spike to be removed;

the third operational portion comprising an arch having two ends, each being connected to and intermediate of the handle; the arch having a teardrop shaped notch positioned on a backside thereof for removing the nail or spike.

* * * * *